US009544687B2

(12) United States Patent
Srinivasan et al.

(10) Patent No.: US 9,544,687 B2
(45) Date of Patent: Jan. 10, 2017

(54) AUDIO DISTORTION COMPENSATION METHOD AND ACOUSTIC CHANNEL ESTIMATION METHOD FOR USE WITH SAME

(71) Applicant: QUALCOMM TECHNOLOGIES INTERNATIONAL, LTD., Cambridge (GB)

(72) Inventors: Ramji Srinivasan, Belfast (GB); Derrick Rea, Belfast (GB); David Trainor, Belfast (GB)

(73) Assignee: QUALCOMM TECHNOLOGIES INTERNATIONAL, LTD., Cambridge (GB)

( * ) Notice: Subject to any disclaimer, the term of this patent is extended or adjusted under 35 U.S.C. 154(b) by 382 days.

(21) Appl. No.: 14/151,079

(22) Filed: Jan. 9, 2014

(65) Prior Publication Data

US 2015/0195647 A1 Jul. 9, 2015

(51) Int. Cl.
*H04R 3/00* (2006.01)

(52) U.S. Cl.
CPC ..... *H04R 3/002* (2013.01); *H04R 2499/13* (2013.01)

(58) Field of Classification Search
CPC ..... H04R 2499/13; H04R 3/002
USPC ..... 381/66, 83, 92, 93, 96; 379/406.01
See application file for complete search history.

(56) References Cited

U.S. PATENT DOCUMENTS 5,956,463 A * 9/1999 Patrick ..... G10L 15/16 119/906
8,180,067 B2 * 5/2012 Soulodre ..... H04M 9/082 381/92
8,233,353 B2 * 7/2012 Zhang ..... H04R 1/406 367/124
2005/0049877 A1 * 3/2005 Agranat ..... A01K 11/008 704/270

(Continued)

FOREIGN PATENT DOCUMENTS

WO 2014008253 A1 1/2014

OTHER PUBLICATIONS

Springer Handbook of Acoustics, Rossing (Editor), ISBN 978-0-387-30446-5, 2007; p. 738.*

(Continued)

*Primary Examiner* — Vivian Chin
*Assistant Examiner* — Friedrich W Fahnert
(74) *Attorney, Agent, or Firm* — Procopio, Cory, Hagreaves & Savitch LLP

(57) ABSTRACT

A method of defining an acoustic channel in a vehicle or other environment involving providing a respective definition of in-vehicle sound sources, the definitions including a definition of a respective sound associated with each sound source and a respective location within the vehicle associated with each sound source. Segments corresponding to the sounds are identified in an output signal of a microphone located in the vehicle. Definitions of acoustic channels are generated from the output signal segments in respect of the location associated with the respective sound source. The (Continued)

sounds relate to intrinsic parts of the vehicle, for example a door closing or a windshield wiper operating. A map of acoustic channels is maintained and used to compensate audio signals for distortion caused by a relevant acoustic channel. The acoustic map can be updated while the vehicle is driving in response to detection of sounds from the sound sources.

30 Claims, 6 Drawing Sheets

(56) References Cited

U.S. PATENT DOCUMENTS

| | | | | |
|---|---|---|---|---|
| 2007/0133811 | A1* | 6/2007 | Hashimoto | G10L 21/0272 381/22 |
| 2007/0183604 | A1* | 8/2007 | Araki | G10L 17/26 381/58 |
| 2007/0247936 | A1* | 10/2007 | Direnzo | G06F 12/0284 365/200 |
| 2009/0306973 | A1* | 12/2009 | Hiekata | G10L 21/028 704/205 |
| 2011/0075860 | A1* | 3/2011 | Nakagawa | G01H 3/00 381/94.1 |
| 2011/0081024 | A1* | 4/2011 | Soulodre | G01S 3/8006 381/17 |
| 2012/0322511 | A1 | 12/2012 | Fox | |

OTHER PUBLICATIONS

GB Search Report issued in related GB Application No. 1416227.5, dated Mar. 13, 2015.

* cited by examiner

AUDIO DISTORTION COMPENSATION METHOD AND ACOUSTIC CHANNEL ESTIMATION METHOD FOR USE WITH SAME

FIELD OF THE INVENTION

The present invention relates to audio distortion compensation and acoustic channel estimation, especially but not exclusively in vehicles.

BACKGROUND TO THE INVENTION

Vehicle manufacturers are introducing speech recognition technology into vehicles for both voice command control of vehicle equipment and as a natural language interface to wider internet-based services. This technology currently performs well with a close-talking microphone but performance drops significantly when the microphone is placed at a distance from the speaker. Sound from the speaker's mouth takes a multi-path route to the microphone because the sound is reflected off different in-vehicle surfaces and reverberated before finally entering the microphone capsule. The microphone also has a characteristic electrical response to the acoustic waves and this cascade of systems leads to distortion of the original speech, making the function of speech recognition more difficult. A similar problem arises during mobile (cellular) telephone conversations when the microphone is remote from the speaker's mouth.

Audio and speech content reproduction technology is well established in the modern vehicle but the quality and intelligibility of the reproductions is often poor. Original recordings are made in environments that are acoustically very different from that inside the vehicle and sounds that appeared bright in the recording studio may be dulled inside the vehicle because the in-vehicle environment acoustically damps out critical component frequencies. Other frequency components of sound may also be boosted by the acoustic environment inside the vehicle to the point that they dominate and create an unnatural or unbalanced listening experience for the user.

Audio capture and reproduction systems offer manufacturers potential to add new value to their vehicles and it would be desirable to provide such systems with the ability to model and correct for the distortion of sound in the vehicle by estimation of acoustic channels.

SUMMARY OF THE INVENTION

A first aspect of the invention provides a method of defining an acoustic channel in an environment, the method comprising: providing a respective definition of at least one sound source in said environment, said respective definition comprising a definition of a respective sound associated with said at least one sound source and a respective location within said environment associated with said at least one sound source; identifying in an output signal of at least one microphone located in said environment at least one output signal segment corresponding to a respective one of said respective sounds; and generating from said at least one output signal segment, and optionally from the respective sound definition, a respective definition of a respective acoustic channel for association with the respective location associated with the respective sound source, and optionally with said at least one microphone, and wherein said at least one sound source comprises a respective intrinsic part of said environment.

A second aspect of the invention provides a method of compensating an audio signal for distortion caused by an acoustic channel in an environment, said method comprising: maintaining an acoustic channel map for said environment, said map comprising at least one acoustic channel definition associated with a respective one of a plurality of locations within said environment; determining a location within said environment corresponding to a source of said audio signal or a destination of said audio signal; selecting from said acoustic channel map at least one of said acoustic channel definitions based on a comparison of said determined location for said audio signal with the respective location associated with said at least one of said acoustic channel definitions; compensating said audio signal using said at least one selected acoustic channel definition.

A third aspect of the invention provides a system for defining an acoustic channel in an environment, the system comprising: at least one storage device storing a respective definition of at least one sound source in said environment, said respective definition comprising a definition of a respective sound associated with said at least one sound source and a respective location within said environment associated with said at least one sound source; an identification module configured to identify in an output signal of at least one microphone located in said environment at least one output signal segment corresponding to a respective one of said respective sounds; and an acoustic channel estimation module configured to generate from said at least one output signal segment, and optionally the respective sound definition, a respective definition of a respective acoustic channel for association with the respective location associated with the respective sound source, and optionally with said at least one microphone, wherein said at least one sound source comprises a respective intrinsic part of said environment.

A fourth aspect of the invention provides a system for compensating an audio signal for distortion caused by an acoustic channel in an environment, said system comprising a distortion compensation module configured to maintain an acoustic channel map for said environment, said map comprising at least one acoustic channel definition associated with a respective one of a plurality of locations within said environment, said distortion compensation module being further configured to determine a location within said environment corresponding to a source of said audio signal or a destination of said audio signal, to select from said acoustic channel map at least one of said acoustic channel definitions based on a comparison of said determined location for said audio signal with the respective location associated with said at least one of said acoustic channel definitions, and to compensate said audio signal using said at least one selected acoustic channel definition.

Preferred embodiments of the invention employ naturally occurring vehicle sounds to characterize the acoustic environment inside a vehicle. Sounds such as doors opening and shutting, doors locking, hazard and indicator light relay clicks, window up and down, and seat position locking are short term audio sounds that fully or partially represent the audio bandwidth range. These sounds tend to have a high acoustic energy and generate electrical signals on microphone outputs that are high above (i.e. distinguishable from) the ambient noise floor inside the vehicle. Preferably, any specific sound that is impulsive in nature and contains a range of audio frequencies (for example the sound of a door shutting, which typically includes wideband speech frequencies up to approximately 8 kHz), preferably substantially the full bandwidth of audio frequencies, can be used to characterize the acoustic channel (provided the amplitude of the sound is sufficiently high to allow it to be distinguished from the ambient noise). Optionally, the measurements from multiple sounds that each contain a range of audio frequencies can be combined to represent the same channel.

Advantageously, an acoustic channel map is constructed using sounds generated from different physical locations inside a vehicle. Preferably, pattern matching techniques are used to uniquely identify a sound type. A particular sound type may be associated with a particular location and so identification of the sound type results in identification of the location. Alternatively, a user may provide an input to the system indicating the sound's location. Alternatively still, a location estimation algorithm may be used to determine a location for a detected sound. Any conventional algorithm may be used for this purpose. For example, in the case where a sound of a particular type may emanate from any one of multiple locations (e.g. a door closing sound), a location estimation algorithm may determine which of the multiple locations is the relevant one by analysing one of more characteristics of the detected sound e.g. time-of-delay and/or amplitude and/or direction, Hence, embodiments of the invention may comprise means for determining the location of a detected sound by any one or more of: direct association with the sound type; user input; or application of a location estimation algorithm, Preferred embodiments of the invention involve using naturally occurring vehicle sounds to blindly estimate acoustic channels in the vehicle that can be grouped to form an acoustic channel map of the interior of the vehicle.

Preferred embodiments of the invention support an audio based method for in-vehicle acoustic channel characterization using naturally occurring vehicle sounds. In particular, preferred embodiments of the invention support characterization of the acoustic environment of the interior of a vehicle using sound sources that are intrinsic to the vehicle and so do not require additional equipment. The preferred method is repeatable and comprehensive across all vehicle type and models.

Further preferred features are recited in the claims appended hereto. Other advantageous aspects of the invention will become apparent to those ordinarily skilled in the art upon review of the following description of a specific embodiment and with reference to the accompanying drawings.

BRIEF DESCRIPTION OF THE DRAWINGS

An embodiment of the invention is now described by way of example and with reference to the accompanying drawings in which.

DETAILED DESCRIPTION OF THE DRAWINGS

Figure 1:
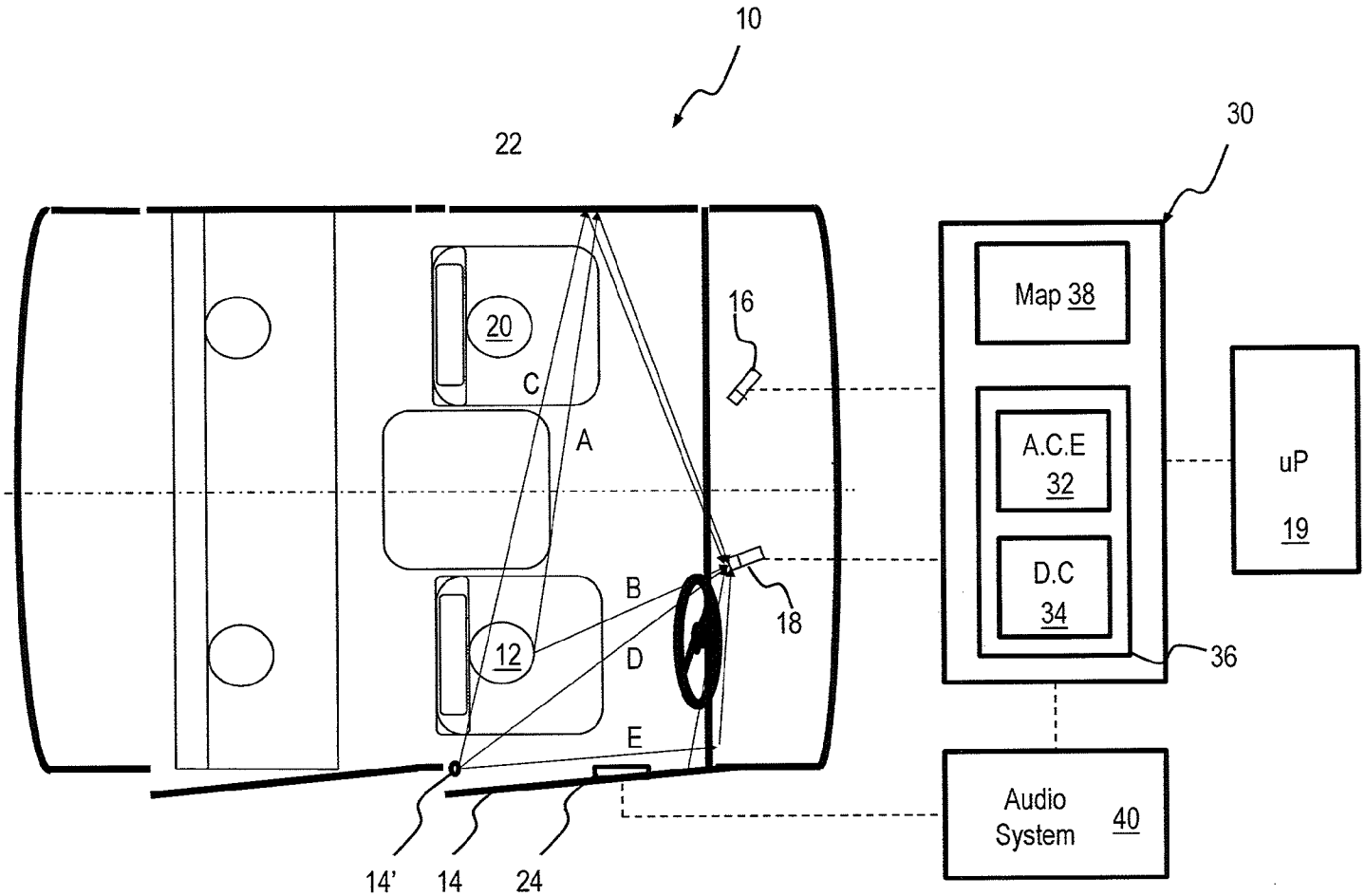
FIG. 1 is a plan view of a vehicle's interior shown together with a block diagram of an audio distortion compensation system embodying one aspect of the present invention.

FIG. 1 illustrates the interior, or cabin, of a vehicle 10, e.g. a car, including first and second sound sources 12, 14 and first and second sound receivers, e.g. microphones 16, 18. The first sound source 12 is assumed to be a human, e.g. the driver, who utters sound in the form of speech. The second sound source 14 is a vehicle door that creates a sound during its normal functioning, in particular when closing. The sound waves emanating from each sound source 12, 14 travel along multiple paths from the source 12, 14 to each microphone 16, 18. By way of example, in FIG. 1 two paths A, B are shown from the source 12 to the microphone 18, and three paths C, D, E are shown from the source 14 to the microphone 18. In practice, there are multiple paths between each sound source and each microphone. The paths from a given sound source to a given microphone may be said to comprise a reverberation channel. Sound detected by the microphones 16, 18 is converted into electrical form and is directed along an electrical path before being provided, typically in digital form, to a signal processing system 19, e.g. a speech recognition system. The electrical path may be said to comprise a microphone channel. The respective reverberation channel and respective microphone channel together provide an acoustic channel from the respective sound source to the signal processing system.

An acoustic channel can be defined as a description of the multiple paths that a sound travels from a source to the receiver. This could be from a loudspeaker to the listener's ears or from a human speaker or a faulty engine component to a microphone. In-vehicle acoustic channels are complex and are characterized by the size of the interior of the vehicle, the reflective and absorption properties of interior surfaces, components, seats and passengers and the relative positions of source and receiver inside the vehicle.

The characteristics of the acoustic channel have a distorting effect on sound emanating from a sound source in the vehicle. For example, speech uttered by the human speaker 12 is distorted by both the acoustic environment of the vehicle 10, i.e. the reverberation channel of which paths A, B are part, and the receiving microphone 18, i.e. the microphone channel, before it is presented to the signal processing system for speech recognition. The greater the distance between the speaker 12 and the receiving microphone 18, the greater the channel distortion tends to be. The aim of a channel compensation technique is to reveal the original speech sound through the channel distortions.

The characteristics of an acoustic channel are defined by the acoustic path (e.g. paths A, B) that the sound travels from source 12 to microphone 18 and the electrical characteristics of the microphone and any associated electrical equipment through which the electrical signal passes before reaching the signal processing system. Since there can be multiple speakers and multiple microphones in a vehicle, there can be multiple acoustic channels by which sound can travel in the vehicle. These acoustic channels can be grouped together in a channel map. The characteristics of each acoustic channel in the channel map depend on the physical co-ordinates of the respective sound source and microphone, and a characterisation of the relevant reverberation and microphone channels. The channel map contains information that can be used to reveal a more accurate digital representation of the original sound, e.g. speech.

Acoustic channels can be modelled in the time and frequency domain and acoustic channel compensation techniques can then be used to correct the acoustic distortion introduced by the channel and deliver a signal to the receiver (human or machine) that is much more representative of the original sound.

FIG. 1 also shows an audio distortion compensation system 30 embodying one aspect of the present invention. The system 30 comprises an acoustic channel estimation system (ACE) 32 and a distortion compensation system (DC) 34. The ACE 32 and DC 34 are typically implemented by computer program code supported by a processor 36, e.g. a digital signal processor. Alternatively, all or part of either or both of the ACE 32 and DC 34 may be implemented using electronic hardware. The system 30 includes an acoustic channel map 38, which may be stored electronically in any convenient manner, e.g. by one or more storage devices, and which is maintained by the ACE 32 and used by the DC 34 as is described in more detail hereinafter. The output signals of each in-vehicle microphone 16, 18 are provided to the system 30 for use in acoustic channel estimation and distortion compensation. The system 30 may provide a distortion-compensated audio signal, derived from any one of the microphone output signals, to the signal processing system 19 and/or any other relevant computing system of the vehicle 10. In addition, the system 30 may perform distortion compensation of the audio output signal from any audio-rendering system 40 of the vehicle (only one representative system 40 shown) before it is rendered by a loudspeaker 24.

Conveniently, each acoustic channel in the channel map 38 is represented by an acoustic channel definition, typically comprising a mathematical definition, for example a transfer function, that is applied to an input signal (e.g. speech uttered at source 12) to produce an output signal (e.g. the electrical, typically digital, representation of the input signal that is rendered to the signal processing system via a microphone). In the following description the acoustic channel definition is assumed to comprise a transfer function but it will be understood that the invention is not limited to this and that any other suitable definition, typically comprising a mathematical channel representation, may be used.

For each microphone 16, 18, the channel map 38 may comprise a respective acoustic channel defined by a respective transfer function for a respective one of multiple locations within the vehicle 10. Advantageously, each location can be correlated with a respective location where a sound is expected to emanate from, e.g. the expected location of a driver or passenger. Hence, when sound, e.g. speech, is detected by a microphone, the DC 34 estimates the location of its source and selects the most appropriate, e.g. closest or best matching, acoustic channel in the channel map 38. The DC 34 then uses the transfer function of the selected acoustic channel to eliminate or reduce the distortion on the output signal from the microphone before rendering the distortion-compensated signal to the signal processing system 19. Typically the transfer function is inverted for application to the to the microphone output signal. With the distortion reduced or removed, the output signal is more readily recognisable by the speech recognition system, or other signal processing system, to which it is provided.

A source sound and corresponding distorted microphone output signal, together with the relevant physical locations, may be used to define an appropriate acoustic channel transfer function. This may be achieved by introducing a known test sound into the acoustic space of the vehicle 10 at predefined sound source and receiver (microphone) positions, to estimate a respective acoustic channel. A disadvantage of this approach is that additional equipment has to be temporarily introduced into the vehicle, which is relatively expensive and impractical.

In preferred embodiments of the invention, the ACE 32 uses blind channel estimation techniques that require the input test sound and/or its source location to be only partially known. Blind channel estimation techniques are only effective however when constraints are imposed on the nature of the input sound source.

When the vehicle door 14 closes, a sound is generated that has relatively high energy compared to ambient vehicle noises. In addition, the door closing sound is repeatable, relatively short in duration and has a wideband audio frequency response. These signal characteristics make the door closing sound suitable for use with blind channel estimation techniques. Moreover, the location of the door 14 is known or can be measured. Typically a location that is deemed to represent the source of the door closing sound is defined, as illustrated in FIG. 1 by 14'. In preferred embodiments, therefore, the sound of the vehicle door closing provides a sound source for use with one or more blind channel estimation algorithms in order to define (i.e. estimate) the acoustic channels between the sound source 14 and each microphone 16, 18 that receives the sound, i.e. to define one or more respective transfer functions for one or more respective acoustic channels of the channel map. Conventional blind channel estimation algorithms may be used for this purpose, for example the multichannel frequency-domain LMS (MCFLMS) algorithm proposed by Huang and Benesty. In preferred embodiments a single transfer function is provided for each sound source/microphone pair even where there are multiple acoustic paths from the source to the microphone, i.e. the transfer function represents an aggregate of the effects of all of the possible acoustic paths from that source to that microphone.

The next step is to use the estimation of the acoustic channel, which in the present example is embodied by the respective transfer function, to improve speech recognition accuracy. This distortion correction is performed by the DC 34 in conjunction with the channel map 38. For example, when speaker 12 begins to talk, the DC 34 may determine his location by applying a speaker localization algorithm to the received output signal from the relevant microphone 16, 18. Any conventional algorithm may be used for this purpose, for example the generalized cross-correlation (GCC) time delay estimation algorithm. Alternatively, a location for the speaker can be determined by determining the direction of the detected speech with respect to the microphone. This method is particularly useful for vehicles in which there are relatively few (typically up to 7) possible seating positions for the speaker. The DC 34 then correlates the speaker's location with at least one acoustic channel in the channel map 38 associated with a sound source that is closest to the location determined for the speaker 12, e.g. the acoustic channel corresponding to the closest door closing sound. The characteristics of the selected acoustic channel from the channel map 38, as defined by the respective transfer function, are then used by the DC 34 to correct the microphone output signal for the speaker 12 to compensate for channel distortion. Typically, this involves applying an inverse of the transfer function to the microphone output signal for the speaker 12, although it will be understood that this depends on how the channels are defined in the channel map. More generally, compensation involves applying a mathematical function derived from the mathematical representation of the channel in order to fully or partially compensate for the effects of the acoustic channel. It is noted that some transfer functions cannot be inverted as a single channel but can be inverted in combination with one or more other transfer functions, for example in accordance with the multiple input/output inverse theorem (MINT). Even though the acoustic channel selected from the map may not be identical to the channel from the speaker 12, they are close enough to allow an improvement in speech recognition accuracy.

In cases where the channel map 38 is deemed not to include an acoustic channel estimation for a location close enough to the determined location of the speaker 12, the DC 34 may interpolate respective channel estimations for two or more acoustic channels in the channel map to produce an acoustic channel estimation for an acoustic channel closer to the determined location of the speaker 12.

As well as compensating for the effects of distortion on speech emanating from a human speaker, the system 30 may be used to compensate for the effects of distortion on sound emanating from the loudspeaker 24 of an audio rendering system (e.g. radio, CD player, mp3 player, telephone system) incorporated into the vehicle 10. To this end the DC 34 may adjust the audio output signal from the audio system 40 before it is rendered by the loudspeaker 24 using at least one selected acoustic channel estimation from the channel map 34. The selected acoustic channel may be one associated with a location inside the vehicle 10 where the driver or a passenger is seated. In cases where the channel map 38 is deemed not to include an acoustic channel estimation for a suitable location, the DC 34 may interpolate respective channel estimations for two or more acoustic channels in the channel map to produce an acoustic channel estimation for a suitable acoustic channel. The DC 34 may select or adjust an acoustic channel, or produce an interpolated acoustic channel, in response to the detection of one or more events by the microphones 16, 18, e.g. the detection of speech from one or more location within the vehicle, or the detection of a door opening or closing.

The channel map 38 preferably comprises estimations of acoustic channels between more than one sound source location and the microphone(s) in the vehicle. For example, the ACE 32 may create a respective acoustic channel estimation for each microphone using each of the vehicle doors as the sound source. Alternatively, or in addition, other naturally occurring sounds inside the vehicle, in particular sounds made by parts that are intrinsic to the vehicle e.g. the click of a key in the ignition, doors opening and shutting, doors locking, hazard and indicator light relay clicks, window operation, seat position locking, switch clicks, user control operation, wiper operation, or seat belt operation, can be used by the ACE 32 to generate acoustic channel estimations for the channel map 38. In particular sounds having relatively high energy compared to ambient noise, being of relatively short duration and having a wideband audio frequency content are suitable for this purpose. More generally, any specific sound that is impulsive in nature and contains multiple audio frequency components, preferably across substantially the entire bandwidth of audio frequencies (for example the sound of a door shutting), can be used to characterize an acoustic channel. Suitable sounds typically result from mechanical operation of a respective part of the vehicle, including mechanical operations caused by the action of a user. Optionally, the measurements from multiple sounds, in particular localised sounds, that each contain a range of audio frequencies can be combined to represent a single channel (which may be referred to as the full channel). Optionally, one or more devices (not shown) may be incorporated into the vehicle at one or more known locations (and which may be regarded as intrinsic) that are operable to generate, or which automatically generate, one or more suitable sounds, especially while the vehicle is driving.

The vehicle sound types identified above are highly repeatable in the same vehicle and consistent in character between different types and models of vehicle. Each sound is easily identifiable and originates from different identifiable locations within the vehicle 10. This allows the acoustic channel map 38 to be generated by the ACE 32 at different time intervals during the use of the vehicle. Since vehicle sounds re-occur when the vehicle is used and are associated with an in-vehicle event, the acoustic map 38 can be updated regularly while the vehicle is being used.

Sounds that occur naturally inside the vehicle often indicate that something has happened that may affect the accuracy of the current acoustic channel map 38. Preferably, detection of such sounds triggers an adjustment of the acoustic channel map. If, for instance, the passenger 20 leaves the vehicle 10, opening and closing the passenger door 22, the channel(s) of the acoustic channel map that have the passenger door 22 as the sound source may be re-calculated (two channels in the example of FIG. 1, one for each microphone 16, 18).

During typical use of the vehicle 10, the driver 10 enters the vehicle and turns on the ignition. Both of these actions generate a vehicle sound that can be used by the ACE 32 to characterize fully or partially the acoustic environment by the creation of, or updating of, respective acoustic channel estimations for the channel map 38. Should a further passenger enter the vehicle, the action of opening and closing the vehicle door creates sounds that allow the map 38 of acoustic channels to be updated. The vehicle 10 is then driven off and, should the driver or a passenger open a window, a further sound is generated that allows an update to the acoustic channel map. More generally, the system 30, and in particular the ACE 32, is configured to recognise at least one sound source that occurs during normal vehicle use and is detected by the, or each, microphone 16, 18 (more generally a single microphone or multiple microphones), and to use the corresponding microphone output signal, together with relevant sound source data (typically comprising a location associated with the sound and optionally a mathematical representation corresponding to the original sound (e.g. a model of the relevant sound type) to produce an acoustic channel estimation, e.g. comprising a transfer function, for inclusion in the channel map 38. It is noted that a representation, e.g. model, of the source sound is used in order to identify suitable segments of the microphone output signal, but depending on which acoustic (blind) channel estimation algorithm(s) are used the source sound representation is not necessarily needed to perform the acoustic channel estimation. However, the source sound representation is involved in creating the acoustic channel map since each sound source representation is associated with a location in the vehicle and so, once the acoustic channel has been estimated, the channel estimation may associated with the said location to maintain the acoustic channel map.

Figure 2:
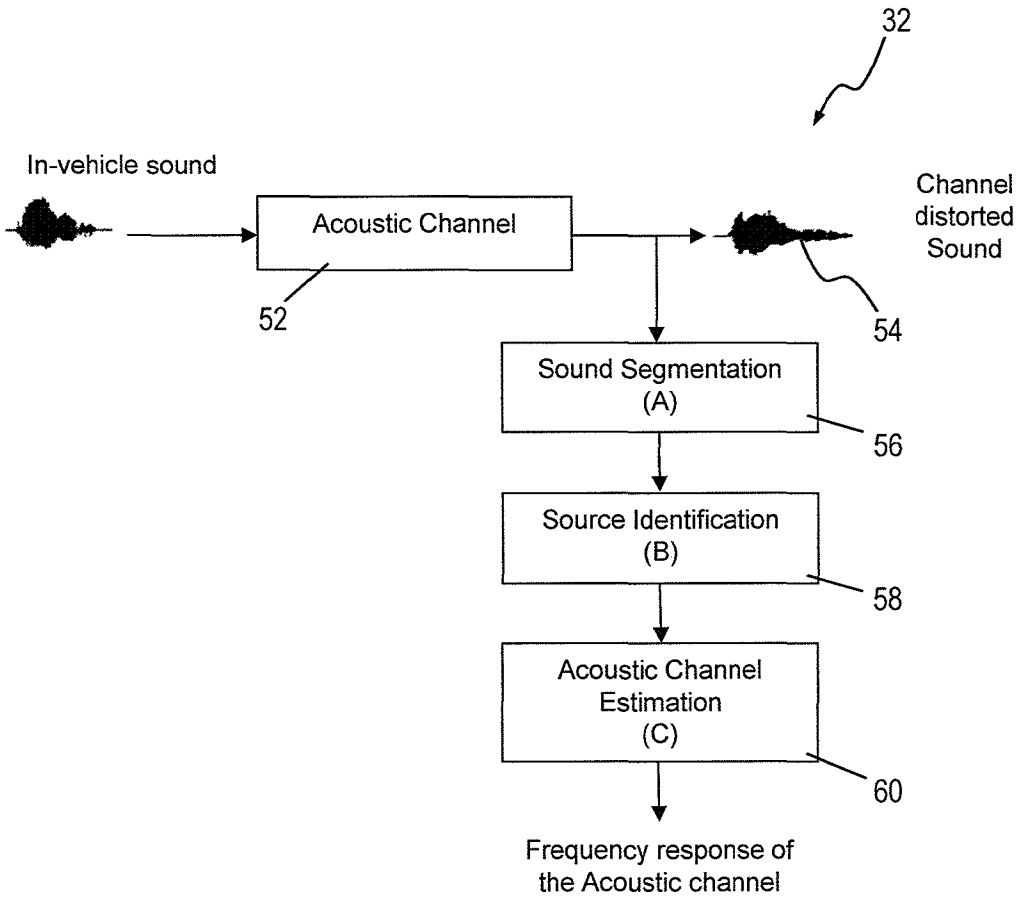
FIG. 2 is a block diagram of an acoustic channel estimator suitable for use in the audio distortion compensation system of FIG. 1 and embodying another aspect of the present invention.
Figure 3:
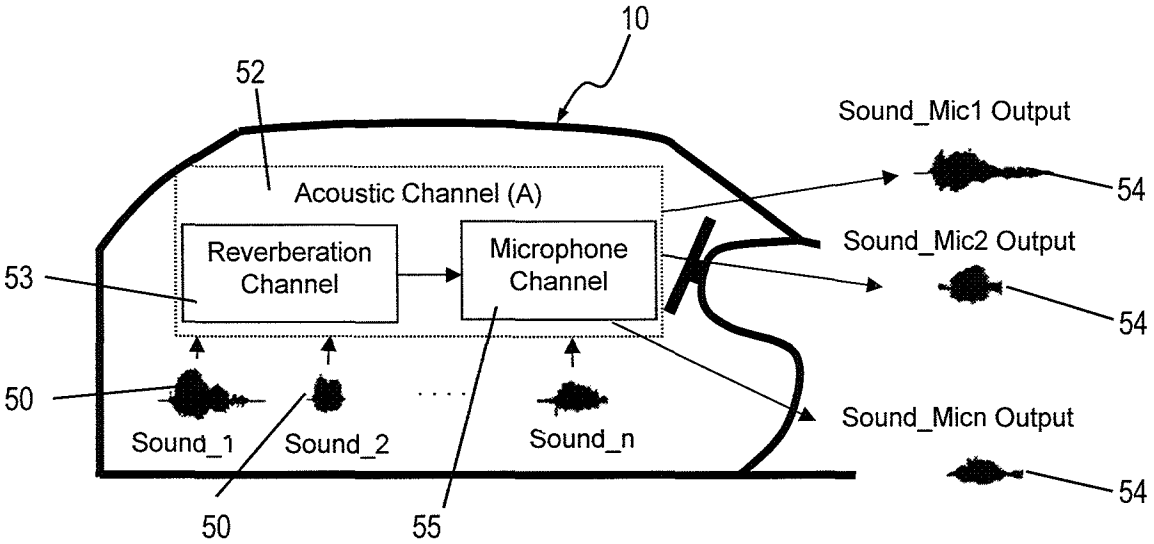
FIG. 3 is a schematic diagram of an in-vehicle acoustic channel acting on in-vehicle sounds.

FIG. 2 is a schematic representation of an embodiment of the ACE 32. FIG. 2 shows an in-vehicle sound 50 generated by a suitable in-vehicle source (not shown) passing through an acoustic channel 52, which introduces a distortion, e.g. filtering effect, to the sound 50 to produce a corresponding distorted sound 54, which in the present example may be assumed to represent the output signal of a respective one of the microphones 16, 18. In order to recover the original sound 50, the distorting effect of the acoustic channel 52 is estimated from the channel affected sound 54 and inverse distortion, e.g. inverse filtering, is applied. To this end, the example ACE 32 comprises a sound segmentation module 56, a source identification module 58 and an acoustic channel estimation module 60. These are described below in the context of the processing of a single sound 50 although it will be understood that multiple sounds may be processed simultaneously by the same or similar means. FIG. 3 illustrates how multiple in-vehicle sounds (Sound_1 to Sound_n) pass through an acoustic channel 52 comprised of a reverberation channel 53 and a microphone channel 55 to produce respective microphone output signals (Sound_Mic1 Output to Sound_Micn_Output). It is noted that the acoustic channel 52 shown in FIG. 3 is representative of multiple acoustic channels, wherein a respective acoustic channel exists in respect of a given in-vehicle location and given microphone. For example, each sound may pass through multiple acoustic channels if it is detected by more than one microphone.

Figure 4:
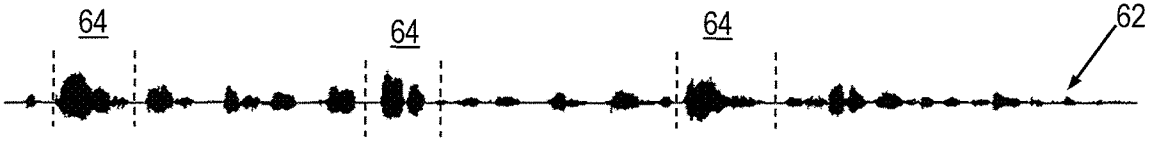
FIG. 4 is a schematic representation of an in-vehicle sound segmentation process.

The sound segmentation module 56 cuts a relatively long, and typically buffered, sound signal 62 into smaller sound segments 64 as shown in FIG. 4. By way of example, the sound signal 62 is segmented into fixed-length short-time audio segments of approximately 150 to 250 ms in length. The sound signal 62 represents the output signal from a microphone and may include components generated by multiple noises detectable within the vehicle 10.

The source identification module 58 determines whether or not each sound segment 64 corresponds with one of the naturally occurring vehicle sounds that can be used to characterize the acoustic environment inside a vehicle as described above, i.e. whether or not each sound segment 64 corresponds to a sound source that the ACE 32 is configured, or trained, to recognize.

Figure 5:
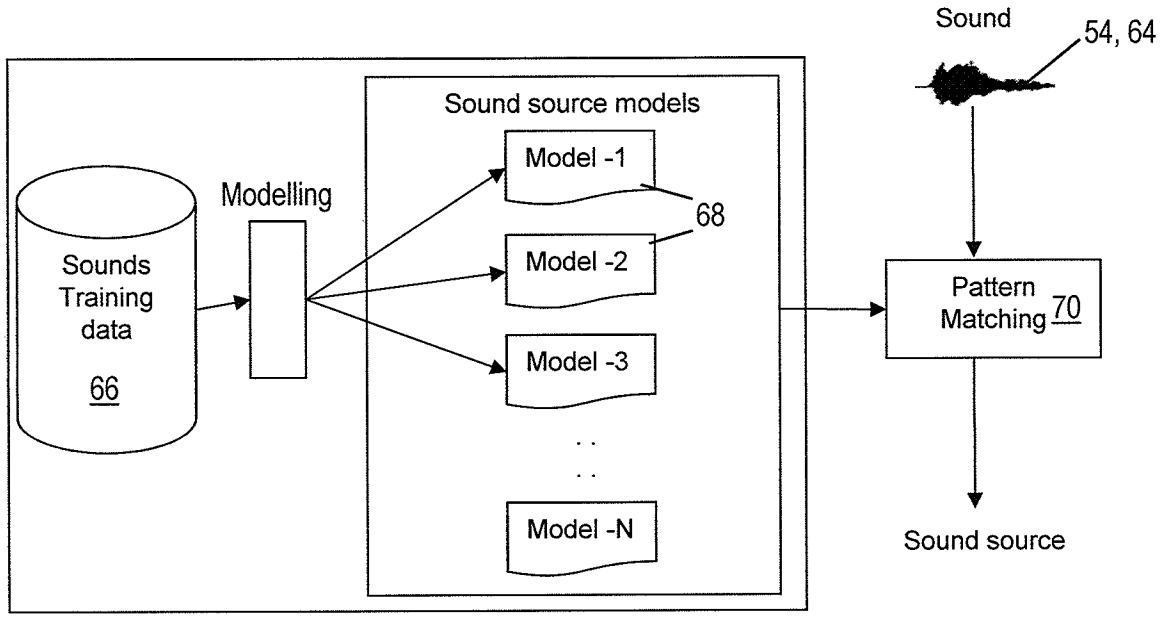
FIG. 5 is a block diagram of a single channel source identification module, suitable for use in the acoustic channel estimator of FIG. 2.

With reference to FIG. 5, in order to recognize suitable sound sources, in a set-up phase of the system 30 suitable vehicle sounds (door closing etc.) are modelled using training data 66 that can be obtained in any convenient manner, e.g. from a pre-existing database of sounds, or by real-time recording of the respective sound-creating event. The training data 66 is organized into sound classes (e.g. vehicle door shutting, hazard light operation etc.) and any suitable conventional mathematical modelling process is applied (by any convenient part of the system 30 or by an external system (not shown) before provision to the system 30) to generate a respective mathematical model 68 for each sound source that the system 30 is to recognize. By way of example, a Gaussian mixture modelling (GMM) technique may be used to model the probability distributions of the mel-frequency cepstral coefficient features of the training data to produce the respective mathematical models.

In use, source identification module 58 compares the sound segments 64 against the mathematical models 68 by any suitable pattern matching process 70 in order to identify which sound segments 64 correspond to valid recognizable sound sources. By way of example, any conventional probabilistic pattern matching algorithm may be used to identify the sound source. However, any conventional single channel or multi channel source estimation technique may alternatively be used.

The acoustic channel estimation module 60 supports the implementation of one or more algorithms that estimate the acoustic channel 52 (i.e. generate a definition, typically a mathematical representation such as a transfer function, of the channel) from one or more distorted sound signals 54 corresponding to a valid sound source, as identified by the source identification module 58. In preferred embodiments, two kinds of algorithms can be used to estimate the acoustic channel: a single channel algorithm; and/or a multi-channel algorithm. Conventional channel estimation algorithms, especially blind channel estimation algorithms may be used by module 60, for example the blind single channel deconvolution using non-stationary signal processing technique proposed by Hopgood and Rayner (for single channels) or the the multichannel frequency-domain LMS (MCFLMS) algorithm proposed by Huang and Benesty (for multiple channels).

Figure 6:
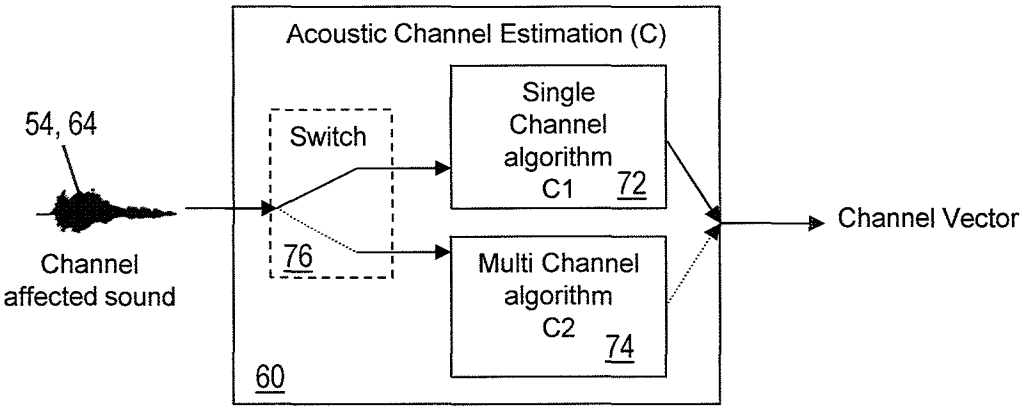
FIG. 6 is a block diagram of an acoustic channel estimation module, suitable for use in the acoustic channel estimator of FIG. 1.

FIG. 6 illustrates a preferred embodiment of the acoustic channel estimation module 60, which supports the selective implementation of a single channel estimation algorithm 72 or a multi-channel estimation algorithm 74 depending on the state of a switch 76. The distorted sound 54 can be switched into either or both of the algorithm implementation modules 72, 74 to obtain an output comprising the channel estimation, i.e. a transfer function or other mathematical representation of the channel 52, which may be referred to as a channel vector or channel response. The channel estimation algorithms are implemented not only using the distorted sound 54 but also the data relating to the sound source that is deemed by the source identification module 58 to have generated the distorted sound 54, which data may include the respective model 68.

Figure 7:
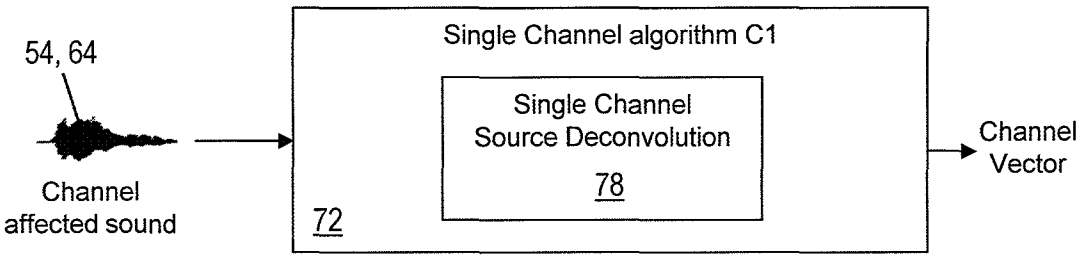
FIG. 7 is a block diagram of a single channel processing module, suitable for use in the acoustic channel estimation module of FIG. 6.

FIG. 7 illustrates an embodiment of the single channel estimation module 72 which supports the implementation of single channel source deconvolution 78 of the distorted sound 54 and the data relating to the respective sound source identified by the source identification module 58 to generate the channel estimation vector. Typically, the single channel source deconvolution involves estimation of the frequency response of the channel by deconvolving the respective sound source data, e.g. model 68, from the distorted sound 54. By way of example, deconvolution may be performed in the log spectral domain and the sound source data may be deconvolved by the way of detrending in the log spectral domain. It will be understood however that any conventional single channel deconvolution techniques can be used to estimate the channel.

Figure 8:
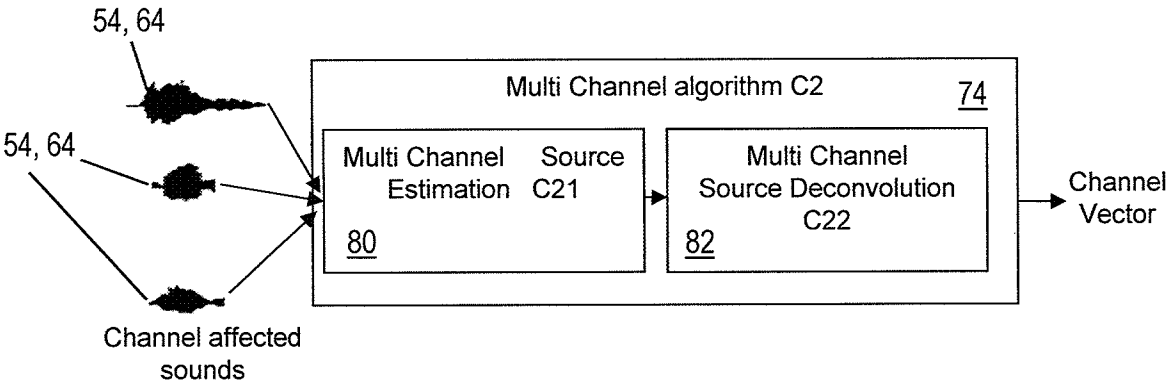
FIG. 8 is a block diagram of a multi-channel processing module, suitable for use in the acoustic channel estimation module of FIG. 6.

FIG. 8 illustrates an embodiment of the multi-channel estimation module 74 which takes channel distorted sounds 54 from multiple microphones as input and generates a channel estimation vector as output. This involves implementation of a source estimation module 80 and a multi-channel source deconvolution module 82.

Figure 9:
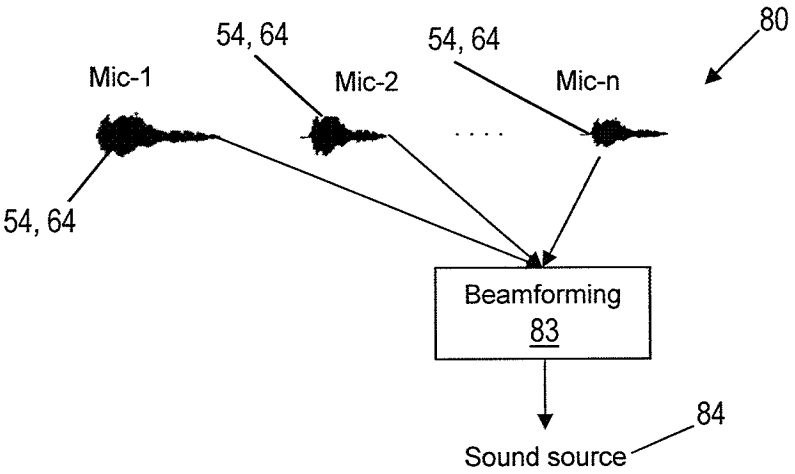
FIG. 9 is a schematic representation of a multi-channel source estimation module, suitable for use with the multi-channel processing module of FIG. 8.

FIG. 9 illustrates an embodiment of the source estimation module 80. Channel distorted sounds 54 from multiple microphones Mic_1 to Mic_n are input to the module 80 and an estimated original sound source with reduced channel distortion is output. The sounds 54 received from the multiple microphones are subjected to a conventional beamforming process 83 which serves to localize the source signal and to improve the signal to noise ratio and reduce reverberation channel effects. In this embodiment, the beamformed sound 84 is assumed to be an estimate of the source sound. However, the configuration should not be considered exclusive and any conventional multi channel source estimation technique may alternatively be used. Beamforming is a means of spatially filtering received sounds to promote a sound from a particular direction. Inputs 54 may comprise multiple sounds from different locations and the beamforming process promotes the sound of interest.

The multi-channel source deconvolution module 82 estimates the frequency response of the channel by deconvolving the source sound data from the distorted sound inputs 54. The sound source data is provided by the sound source estimation module 80 as described above. In the present example, deconvolution is performed in the log spectral domain and the source data is deconvolved by way of log spectral subtraction. However, any conventional multi-channel deconvolution technique may be used for this purpose, for example involving time domain deconvolution or frequency domain division.

The sound segmentation process can be performed using any one or combination of conventional methods (for example Bayesian Information Criteria, model based, amongst others).

The source identification process can be performed using any one or combination of conventional methods (for example threshold based methods, model based methods, template matching methods, amongst others).

Single channel deconvolution can be performed using any one or combination of conventional methods (for example frequency domain methods, time domain methods, model based methods, amongst others).

Multi channel source deconvolution can be performed using any one or combination of conventional methods (for example Independent component analysis, information maximization methods, adaptive beamforming methods, model based methods, amongst others).

The following advantageous aspects of preferred embodiments of the invention will be apparent from the foregoing. The sound sources used to characterize the acoustic environment are naturally occurring in the vehicle and so estimation of acoustic channels is simplified because no external sound reproduction equipment is required. Advantageously, the sound pressures generated by the sound sources are at levels where all frequencies bands sit above ambient noise floor level yet are acceptable to vehicle passengers. The sound sources are repeatable within the context of a single vehicle. The preferred sound sources are re-occurring and associated with in-vehicle events that commonly change the acoustic environment. Each sound source can be uniquely identified and physically located. The sound sources are at different physical locations within the vehicle and so allow generation of an acoustic channel map.

Although the invention is described herein in the context of a vehicle, it may be applied to other acoustic environments in which similar sound sources occur and are detectable by one or more microphones, for example an auditorium, theatre, cinema and so on.

The invention is not limited to the embodiment(s) described herein but can be amended or modified without departing from the scope of the present invention.

The invention claimed is:

1. A method for use in speech recognition in a vehicle, said method using an acoustic channel map storing information about each of a plurality of sound sources intrinsic to said vehicle, the information including a location of the sound source and an acoustic channel definition including a transfer function describing an acoustic channel between the sound source and a microphone, said method comprising:

detecting speech using the microphone;

determining a location within said vehicle of a source of the detected speech;

determining an acoustic channel definition for compensating the detected speech based on said determined location and the locations stored in said acoustic channel map; and compensating said detected speech using said determined acoustic channel definition.

2. The method as claimed in claim 1, wherein the plurality of sound sources intrinsic to said vehicle include a mechanically operable part of said vehicle.

3. The method as claimed in claim 1, wherein compensating said detected speech includes applying a mathematical function derived from a transfer function associated with the determined acoustic channel definition.

4. The method as claimed in claim 1, wherein determining said acoustic channel definition includes:

identifying the sound source whose location is closest to the determined location of the source of the detected speech; and selecting the acoustic channel definition associated the identified sound source.

5. The method as claimed in claim 1, wherein determining said acoustic channel definition includes:

identifying sound sources whose locations are near the determined location of the source of the detected speech;

selecting the acoustic channel definitions associated the identified sound sources; and interpolating said selected acoustic channel definitions to produce the acoustic channel definition for compensating said detected speech.

6. The method as claimed in claim 1, wherein determining the location of the source of the detected speech utilizes a speaker localization algorithm.

7. The method as claimed in claim 6, wherein the speaker localization algorithm includes determining a direction of the detected speech with respect to the microphone.

8. The method as claimed in claim 1, wherein determining the location of the source of the detected speech is based on an expected location of a driver or passenger of the vehicle.

9. The method as claimed in claim 1, further comprising updating the acoustic channel map.

10. The method as claimed in claim 9, wherein updating the acoustic channel map is triggered by detection of a sound indicating a change in the vehicle that affects accuracy of the acoustic channel map.

11. The method as claimed in claim 9, wherein the information stored in the acoustic channel map about each of a plurality of sound sources intrinsic to said vehicle further includes a definition of a sound associated with the sound source, and wherein updating the acoustic channel map includes:

identifying, in an output signal of the microphone, a signal segment matching one of the sound definitions;

generating, using the identified signal segment and the matched sound definition, a transfer function describing the associated acoustic channel; and updating the acoustic channel map with the generated transfer function.

12. The method as claimed in claim 11, wherein the matched sound definition is an impulsive sound.

13. The method as claimed in claim 11, wherein identifying the signal segment includes segmenting said output signal into output signal segments, and comparing said output signal segments with said sound definitions.

14. The method as claimed in claim 13, wherein comparing said output signal segments with said sound definitions includes applying at least one pattern matching algorithm to said output signal segments and said sound definitions.

15. The method as claimed in claim 11, wherein generating the transfer function includes application of at least one blind channel estimation algorithm to said identified signal segment and the matched sound definition.

16. The method as claimed in claim 11, wherein generating the transfer function includes application of at least one single channel estimation algorithm to said identified signal segment and the matched sound definition.

17. The method as claimed in claim 16, wherein said application of said at least one single channel estimation algorithm includes applying at least one single channel source deconvolution algorithm to said identified signal segment and the matched sound definition.

18. The method as claimed in claim 11, wherein generating the transfer function includes application of at least one multi-channel estimation algorithm to said identified signal segment and the matched sound definition.

19. The method as claimed in claim 18, wherein said application of at least one multi-channel estimation algorithm includes applying a multi-channel source estimation algorithm to a plurality of identified signal segments to generate an estimated sound definition, and applying at least one multi-channel source deconvolution algorithm to said plurality of identified signal segments and said estimated sound definition.

20. An audio distortion compensation system for use in speech recognition in a vehicle, the system comprising:

a storage device storing an acoustic channel map having information about each of a plurality of sound sources intrinsic to a vehicle, the information including a location of the sound source and an acoustic channel definition including a transfer function describing an acoustic channel between the sound source and a microphone;

a processor coupled to the storage device and a microphone, the processor configured to detect speech using the microphone;

determine a location within said vehicle of a source of the detected speech;

determine an acoustic channel definition for compensating the detected speech based on said determined location and the locations stored in said acoustic channel map;

compensate said detected speech using said determined acoustic channel definition.

21. The audio distortion compensation system as claimed in claim 20, wherein compensating said detected speech includes applying a mathematical function derived from a transfer function associated with the determined acoustic channel definition.

22. The audio distortion compensation system as claimed in claim 20, wherein determining said acoustic channel definition includes:

identifying the sound source whose location is closest to the determined location of the source of the detected speech; and selecting the acoustic channel definition associated the identified sound source.

23. The audio distortion compensation system as claimed in claim 20, wherein determining said acoustic channel definition includes:

identifying sound sources whose locations are near the determined location of the source of the detected speech;

selecting the acoustic channel definitions associated the identified sound sources; and interpolating said selected acoustic channel definitions to produce the acoustic channel definition for compensating said detected speech.

24. The audio distortion compensation system as claimed in claim 20, wherein determining the location of the source of the detected speech is based on an expected location of a driver or passenger of the vehicle.

25. The audio distortion compensation system as claimed in claim 20, wherein the process is further configured to update the acoustic channel map.

26. The audio distortion compensation system as claimed in claim 25, wherein updating the acoustic channel map is triggered by detection of a sound indicating a change in the vehicle that affects accuracy of the acoustic channel map.

27. The audio distortion compensation system as claimed in claim 25, wherein the information stored in the acoustic channel map about each of a plurality of sound sources intrinsic to said vehicle further includes a definition of a sound associated with the sound source, and wherein updating the acoustic channel map includes:

identifying, in an output signal of the microphone, a signal segment matching one of the sound definitions;

generating, using the identified signal segment and the matched sound definition, a transfer function describing the associated acoustic channel; and updating the acoustic channel map with the generated transfer function.

28. The audio distortion compensation system as claimed in claim 27, wherein identifying the signal segment includes segmenting said output signal into output signal segments, and comparing said output signal segments with said sound definitions.

29. The audio distortion compensation system as claimed in claim 27, wherein generating the transfer function includes application of at least one blind channel estimation algorithm to said identified signal segment and the matched sound definition.

30. The audio distortion compensation system as claimed in claim 27, wherein generating the transfer function includes applying source deconvolution algorithm to said identified signal segment and the matched sound definition.

* * * * *